US009536539B2

(12) United States Patent
Chang et al.

(10) Patent No.: US 9,536,539 B2
(45) Date of Patent: Jan. 3, 2017

(54) NONLINEAR ACOUSTIC ECHO SIGNAL SUPPRESSION SYSTEM AND METHOD USING VOLTERRA FILTER

(71) Applicant: INDUSTRY-UNIVERSITY COOPERATION FOUNDATION HANYANG UNIVERSITY, Seoul (KR)

(72) Inventors: Joon Hyuk Chang, Seoul (KR); Ji Hwan Park, Seoul (KR)

(73) Assignee: INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 0 days.

(21) Appl. No.: 14/788,431

(22) Filed: Jun. 30, 2015

(65) Prior Publication Data

US 2016/0005419 A1 Jan. 7, 2016

(30) Foreign Application Priority Data

Jul. 1, 2014 (KR) ..... 10-2014-0081748

(51) Int. Cl.
*G10L 21/0208* (2013.01)
*G10L 21/0232* (2013.01)
*G10L 21/0264* (2013.01)

(52) U.S. Cl.
CPC ..... *G10L 21/0232* (2013.01); *G10L 21/0264* (2013.01); *G10L 2021/02082* (2013.01)

(58) Field of Classification Search
CPC ..... G10L 21/0232; G10L 21/0264; G10L 2021/02082
USPC ..... 704/200, 200.1, 205, 225, 234, 250
See application file for complete search history.

(56) References Cited

U.S. PATENT DOCUMENTS

2002/0002455 A1* 1/2002 Accardi ..... G10L 21/0208 704/226
2004/0122667 A1* 6/2004 Lee ..... G10L 25/78 704/233
2008/0082328 A1* 4/2008 Lee ..... G10L 25/78 704/234
2015/0003606 A1* 1/2015 Nemer ..... H04M 9/082 379/406.01
2015/0071461 A1* 3/2015 Thyssen ..... G10L 21/0208 381/94.1

OTHER PUBLICATIONS

Jihwan Park et al., "Nonlinear Acoustic Echo Suppressor based on Volterra Filter using Least Squares", Journal of the Institute of Electronics Engineers of Korea, Dec. 2013, pp. 3143-3147, vol. 50, No. 12.

(Continued)

*Primary Examiner* — Marcellus Augustin

(57) ABSTRACT

A nonlinear acoustic echo signal suppression system and method using a Volterra filter is disclosed. The nonlinear acoustic echo signal suppression system includes an acoustic echo signal estimator configured to estimate a nonlinear acoustic echo signal by using a Volterra filter in a frequency filter, and a near-end talker speech signal generator configured to generate a near-end talker speech signal, in which the nonlinear acoustic echo signal is suppressed, by using a gain function based on a statistical model.

11 Claims, 8 Drawing Sheets

(56) References Cited

OTHER PUBLICATIONS

Kyu-Ho Lee et al., "Frequency-Domain Double-Talk Detection Based on the Gaussian Mixture Model", IEEE Signal Processing Letters, May 2010, pp. 453-456, vol. 17, No. 5, IEEE.
Jihwan Park et al., "Frequency-Domain Volterra Filter Based on Data-Driven Soft Decision for Nonlinear Acoustic Echo Suppression", IEEE Signal Processing Letters, Sep. 2014, pp. 1088-1092, vol. 21, No. 9, IEEE.

* cited by examiner

FIG. 8

COMPARISON OF MOS SCORES IN VARIOUS CLIPPING ENVIRONMENTS

| Clipping type | Method | Clipping degree (%) | | | | |
|---|---|---|---|---|---|---|
| | | 90 | 80 | 70 | 60 | 50 |
| Hard clipping | AES [1] | 3.29 | 3.22 | 3.18 | 3.08 | 3.03 |
| | AEC+Raised=cosin [6] | 3.23 | 3.18 | 3.15 | 3.12 | 3.08 |
| | AEC+Voltera [5] | 3.25 | 3.20 | 3.17 | 3.15 | 3.10 |
| | Proposed | 3.41 | 3.37 | 3.35 | 3.33 | 3.15 |
| Soft clipping | AES [1] | 3.23 | 3.18 | 3.15 | 3.05 | 3.05 |
| | AEC+Raised-cosine [6] | 3.25 | 3.25 | 3.20 | 3.19 | 3.08 |
| | AEC+Volterra [5] | 3.28 | 3.28 | 3.23 | 3.23 | 3.10 |
| | Proposed | 3.48 | 3.39 | 3.35 | 3.35 | 3.27 |

NONLINEAR ACOUSTIC ECHO SIGNAL SUPPRESSION SYSTEM AND METHOD USING VOLTERRA FILTER

CROSS-REFERENCE TO RELATED APPLICATIONS

A claim for priority under 35 U.S.C. §119 is made to Korean Patent Application No. 10-2014-0081748, filed on Jul. 1, 2014, in the Korean Intellectual Property Office, the entire contents of which are hereby incorporated by reference.

BACKGROUND

Embodiments of the inventive concept described herein relate to technology for nonlinear acoustic echo signal suppression by estimating a filter factor of a Volterra filter through a Multi-Tap Least Squares (MTLS) estimator and by estimating a prior near-end speech presence probability ratio (the ratio of the a priori probability of near-end speech presence and absence; Q) by a data-driven algorithm.

Nonlinear acoustic echo power signal estimation is generally obtained using cascade structures, power filters, or Volterra filters.

The cascade structure, as a mode of nonlinear acoustic echo signal estimation based on a raised-cosine function, operates to adaptively modify function factors to modify the raised-cosine function for nonlinearity of a system. The modified function factors are used to estimate the optimum power of nonlinear acoustic echo signal.

The power filter models a nonlinear acoustic echo signal in power series and adaptively modifies power series factors which properly represent a nonlinear acoustic echo signal from an output signal of a linear speaker. The modified power series factors are used to estimate the optimum power of nonlinear acoustic echo signal. The cascade structure and the power filter are known as inferior to the Volterra filter in performance.

The Volterra filer models a nonlinear acoustic echo signal in Volterra series. With the Volterra filter, Volterra series factors properly representing a nonlinear acoustic echo signal from an output signal of a nonlinear speaker is adaptively found to estimate the optimum power of nonlinear acoustic echo signal.

However, in the Volterra filter, as an adaptive algorithm such as Normalized Least Mean Square (NLMS) is used to update Volterra filter factors, it is difficult to offer fast adaptation to abrupt variations of environment and nonlinearity. For example, as the Volterra filter uses fixed constants, it is difficult to provide adaptation to circumferential environments of speaker and microphone until a speech signal output from the speaker is input into the microphone.

Therefore, it needs a solution quickly adaptable to abrupt variations of environments and nonlinearity.

SUMMARY

One aspect of embodiments of the inventive concept is directed to provide technology of estimating Volterra filter factors by using an MTLS estimator for fast adaptation to abrupt variations of environment and nonlinearity, and outputting a near-end talker speech signal with nonlinear acoustic echo signal suppression by using near-end speech absence probability based on a data-driven algorithm.

According to one aspect of the inventive concept, an on linear acoustic echo signal suppression system may include an acoustic echo signal estimator configured to estimate a nonlinear acoustic echo signal by using a Volterra filter in a frequency filter and a near-end talker speech signal generator configured to generate a near-end talker speech signal, in which the nonlinear acoustic echo signal is suppressed, by using a gain function based on a statistical model.

In an embodiment, the acoustic echo signal estimator may estimate a filter factor of the Volterra filter by using a multi-tap least square estimator, and estimate the nonlinear acoustic echo signal by using the filter factor of the Volterra filter.

In an embodiment, the near-end talker speech signal generator may estimate a prior near-end talker speech presence probability ratio, which is variable, from a data-driven algorithm, and generate the near-end talker speech signal from the estimated prior near-end talker speech presence probability ratio and the gain function.

In an embodiment, the prior near-end speech presence probability ratio may be variable according to the near-end talker speech signal, and applied to near-end speech absence probability based on a complex Laplacian probability distribution.

In an embodiment, the near-end talker speech signal generator may calculate near-end speech absence probability based on a complex Laplacian model, and suppress the nonlinear acoustic echo signal based on the near-end talker speech absence probability and the gain function.

According to another aspect of the inventive concept, a nonlinear acoustic echo signal suppression method may include the steps of estimating a nonlinear acoustic echo signal by using a Volterra filter in a frequency domain, and generating a near-end talker speech signal, in which the nonlinear acoustic echo signal is suppressed, by using a gain function based on a statistical model.

In an embodiment, the step of estimating the nonlinear acoustic echo signal may include the steps of estimating a filter factor of the Volterra filter by using a multi-tap least square estimator, and estimating the nonlinear acoustic echo signal by using the filter factor of the Volterra filter.

In an embodiment, the step of generating the near-end talker speech signal may include the step of estimating a prior near-end talker speech presence probability ratio, which is variable, from a data-driven algorithm, and generating the near-end talker speech signal from the estimated prior near-end talker speech presence probability ratio and the gain function.

In an embodiment, the prior near-end speech presence probability ratio may be variable according to the near-end talker speech signal, and applied to near-end speech absence probability based on a complex Laplacian probability distribution.

In an embodiment, the step of generating the near-end talker speech signal may include the steps of calculating near-end speech absence probability based on a complex Laplacian model, and suppressing the nonlinear acoustic echo signal based on the near-end talker speech absence probability and the gain function.

According to embodiments of the inventive concept, it may be immediately adaptable to abrupt variations of environment and nonlinearity by using an MTLS estimator to estimate Volterra filter factors, and using Near-end Speech Absence Probability (NSAP), based on a data-driven algorithm, to output a near-end talker speech signal with nonlinear acoustic echo signal suppression.

BRIEF DESCRIPTION OF THE FIGURES

FIG. 8 is a diagram showing Mean Opinion Score (MOS) test results in an embodiment of the inventive concept.

DETAILED DESCRIPTION

Now hereinafter will be described exemplary embodiments of the inventive concept in conjunction with accompanying drawings.

Figure 1:
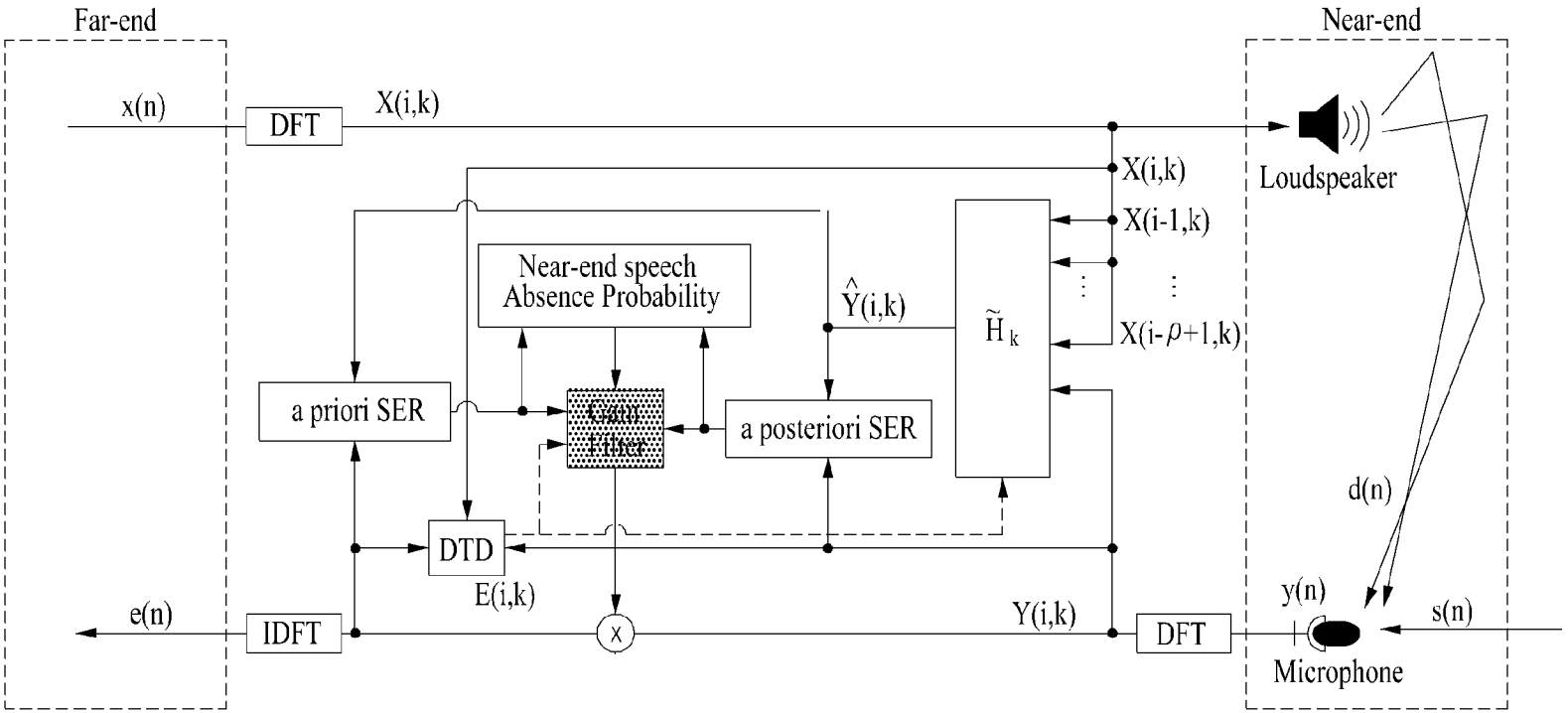
FIG. 1 is a block diagram illustrating a schematic configuration of a nonlinear acoustic echo signal suppression system according to an embodiment of the inventive concept.

FIG. 1 is a block diagram illustrating a schematic configuration of a nonlinear acoustic echo signal suppression system according to an embodiment of the inventive concept.

In FIG. 1, Y(i,k) may denote a signal which is converted from a microphone input signal y(t) in Short-Time Fourier Transform (STFT), D(i,k) may denote a signal which is converted from a nonlinear acoustic echo signal d(t) in STFT, S(i,k) is a signal which is converted from a pure near-end talker speech signals(t) in STFT, i may denote a frame index, and k may denote a frequency index. Then, relations among the microphone input signal, the near-end talker speech signal, and the nonlinear acoustic echo signal may be given in Equation 1 as follows. Instead of STFT, Fast Fourier Transform or Discrete Fourier Transform (DFT) may be used therefor.

$$h_0:\ Y(i,k)=D(i,k)$$

$$h_1:\ Y(i,k)=D(i,k)+S(i,k) \qquad \text{[Equation 1]}$$

From Equation 1, $h_0$ may denote that only a nonlinear acoustic echo signal d(t) becomes a signal s(t) input into a microphone if there is no speech through the microphone, and $h_1$ may denote a signal s(t) which is input into a microphone by addition with a nonlinear acoustic echo signal d(t) and a near-end talker speech signals(t) if there is a speech through the microphone.

In this manner, a nonlinear acoustic echo signal input into a microphone may act to hinder in recognizing a near-end talker speech signal. From the reason, an operation of outputting a near-end talker speech signal, by estimating a nonlinear acoustic echo signal and suppressing the estimated nonlinear acoustic echo signal, will be described hereinafter in detail with reference the accompanying drawings.

Figure 2:
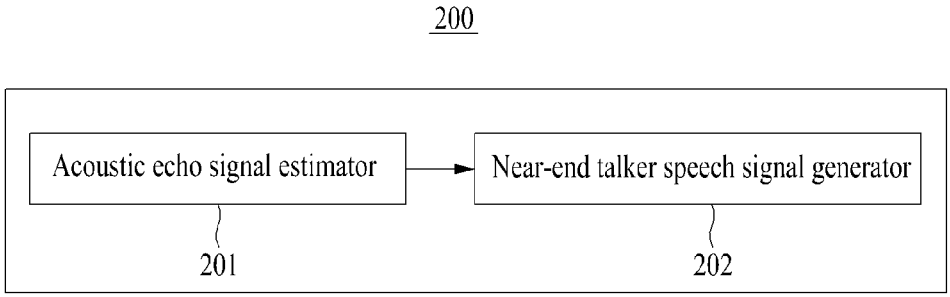
FIG. 2 is a block diagram illustration a detailed configuration of a nonlinear acoustic echo signal suppression system according to an embodiment of the inventive concept.

FIG. 2 is a block diagram illustration a detailed configuration of a nonlinear acoustic echo signal suppression system according to an embodiment of the inventive concept.

Referring to FIG. 2, the nonlinear acoustic echo signal suppression system 200 may include an acoustic echo signal estimator 201 and a near-end talker speech signal generator 202.

The acoustic echo signal estimator 201 may use a Volterra filter in a frequency domain to estimate a nonlinear acoustic echo signal. For example, the acoustic echo signal estimator 201 may convert an input signal x(n) in DFT, and estimate a nonlinear acoustic echo signal by using a Volterra filter in a frequency domain of the DFT converted signal X(i,k).

During this, it may be permissible to use Multi-Tap Least Square (MTLS) for estimating a filter factor of the Volterra filter, and then estimate a nonlinear acoustic echo signal based on the estimated filter factor of the Volterra filter. For example, the acoustic echo estimator 201 may estimate a filter factor of the Volterra filter and a nonlinear acoustic echo signal, based on Equation 2 through Equation 7 as follows.

$$|\hat{D}(i,k)| = \hat{H}_1(k)|X(i,k)| + \sum_{p=0}^{K-1}\sum_{q=0}^{K-1}\hat{H}_2(p,q)|X(i,p)||X(i,q)|\delta_K(k-p-q) \qquad \text{[Equation 2]}$$

In Equation 2, $\hat{H}_1(k)$ may denote an estimated value of a linear filter as one component of a secondary Volterra filter, and $\hat{H}_2(p,q)$ may denote an estimated value of a quadratic filter as the other component of the secondary Volterra filter. And, K may denote the maximum value of a frequency index. $\hat{D}(i,k)$ may denote an estimated value of a nonlinear acoustic echo signal and X(i,k) may denote a DFT converted signal at a far-end stage.

During this, the acoustic echo signal estimator 201 may determine p and q which are indexes of the quadratic filter, based on Equation 3 as follows. The acoustic echo signal estimator 201 may determine the indexes p and q to satisfy Equation 3.

$$\delta_K(k) = \begin{cases} 1, & (k \text{ modulo } K) = 0 \\ 0, & (k \text{ modulo } K) \neq 0 \end{cases} \qquad \text{[Equation 3]}$$

As described with Equation 2 and Equation 3, the acoustic echo signal estimator 201 may use MTLS to estimate a Volterra filter factor in a frequency domain.

In this regard, it may be accomplishable to improve estimation accuracy for the filter factor because the acoustic echo signal estimator 201 uses multiple taps to estimate a single Volterra filter factor. Additionally, a filter factor estimated by using multiple taps may have a smaller variation than that estimated by using a single tap. Accordingly, it may be allowable to estimate Acoustic Transfer Function (ATF) more accurately.

Although, in Equations 2 and 3, a nonlinear acoustic echo signal is estimated by calculating an estimated value of an acoustic echo signal with a secondary Volterra filter, it may be confined in an embodiment. The acoustic echo signal estimator 201 may even employ third, fourth, . . . , and n'th Volterra filters in addition to the secondary Volterra filter under consideration of the complexity of calculation. For example, Equation 2 given to estimate a secondary Volterra filter factor may be rearranged into Equation 4 to estimate a Volterra filter factor which has a degree of ρ.

$$|\hat{D}(i,k)| = \sum_{n=0}^{\rho-1}\left[\hat{H}_{1,n}(k)|X(i-n,k)| + \sum_{\tau=0}^{K-1}\hat{H}_{2,n}(p_{k,\tau},q_{k,\tau})|X(i-n,p_{k,\tau})||X(i-n,q_{k,\tau})|\right] \quad \text{[Equation 4]}$$

In Equation 4, k and τ may denote frequency indexes between 0 and K−1, n may denote filter degree indexes valued in the range between 0 and ρ-1, $\hat{H}_{1,n}$ may denote an estimated value of a linear filter of an n'th Volterra filter, and $\hat{H}_{2,n}$ may denote an estimated value of a quadratic filter of the n'th Volterra filter. And, $p_{k\tau}$ and $q_{k\tau}$ may denote indexes of the quadratic filter. The acoustic echo signal estimator 201 may determine $p_{k\tau}$ and $q_{k\tau}$ from values which meet $\delta_K(k-p_{k\tau}-q_{k\tau})=1$.

During this, the nonlinear acoustic echo signal $\hat{D}(i,k)$ may be given in a form of vector-matrix by Equation 5 as follows.

$$|\hat{D}(i,k)|=|\hat{H}_1^T(k),\hat{H}_{2,0}^T(k),\hat{H}_{2,1}^T(k),\ldots,\hat{H}_{2,K-1}^T(k)|[X_1^T(i,k),X_{2,0}^T(i,k),X_{2,1}^T(i,k),\ldots,X_{2,K-1}^T(i,k)]^T \quad \text{[Equation 1]}$$

In Equation 5, $X_1(i,k)$, $X_{2,\tau}(i,k)$, $\hat{H}_1(k)$, $\hat{H}_{2,\tau}(k)$ may be given in Equation 6 as follows.

$$X_1(i,k)=[|X(i,k)|,|X(i-1,k)|,\ldots,|X(i-p+1,k)|]^T,$$

$$X_{2,\tau}(i,k)=[|X(p_{k,\tau})||X(i,q_{k\tau})|,|X(i-1,p_{k,\tau})||X(i-1,q_{k,\tau})|,\ldots,|X(i-p+1,p_{k,\tau})||X(i-p+1,q_{k,\tau})|]^T,$$

$$\hat{H}_1(k)=|\hat{H}_{1,0-1}(k),\hat{H}_{1,0-2}(k),\ldots,\hat{H}_{1,0}(k)|^T,$$

$$\hat{H}_{2\tau}(k)=[\hat{H}_{2,p-1}(p_{k,\tau}q_{k,\tau}),\hat{H}_{2,p-2}(p_{k,\tau}q_{k,\tau}),\ldots,\hat{H}_{2,0}(p_{k,\tau}q_{k,\tau})]^T \quad \text{[Equation 6]}$$

In Equation 5, the nonlinear acoustic echo signal may be simply given in Equation 7 as follows by using only a Volterra filter factor and an input signal.

$$|\hat{H}(i,k)|=\underline{\hat{H}}_k^T\underline{X}_{i,k} \quad \text{[Equation 7]}$$

In Equation 7, the estimated value of the Volterra filter, $\hat{H}_k$, may be $[\hat{H}_1^T(k), \hat{H}_{2,0}^T(k), \hat{H}_{2,1}^T(k),\ldots,\hat{H}_{2,K-1}(k)]^T$, and the input signal to the Volterra filter, $\underline{X}_{i,k}$, may be $[X_1^T(i,k), X_{2,0}^T(i,k), X_{2,1}^T(i,k),\ldots,X_{2,K-1}^T(i,k)]^T$. Here, the estimated value of the Volterra filter, $\underline{\hat{H}}_k$, may be updated, based on MTLS, and expressed in $\underline{\hat{H}}_k=R_k^{\dagger}r_k$. In this regard, $R_k=\underline{X}_{i,k}\underline{X}_{i,k}^H$, $r_k=|Y(i,k)|\underline{X}_{i,k}$, and † may denote a pseudo-inverse.

As shown in Equation 7, the acoustic echo signal estimator 201 may estimate the filter factor of the Volterra filter, $\underline{\hat{H}}_k$, based on MTLS, and estimate the nonlinear acoustic echo signal $\hat{D}(i,k)$ from the estimated filter factor of the Volterra filter and the input signal $\underline{X}_{i,k}$.

Then, the acoustic echo signal estimator 201 may use an amplitude of the nonlinear acoustic echo signal, $|\hat{D}(i,k)|$, and a long-term smoothing method to calculate a power spectrum $\hat{\lambda}_d(i,k)$.

For instance, the acoustic echo signal estimator 201 may calculate the power spectrum, based on Equation 8 as follows, in a period where there is no near-end talker speech signal.

$$\hat{\lambda}_d(i,k)=\zeta_{\lambda_d}\hat{\lambda}_d(i-1,k)+(1-\zeta_{\lambda_d})|\hat{D}(i,k)|^2 \quad \text{[Equation 8]}$$

From Equation 8, $\zeta_{\lambda_d}$ may be exemplarily 0.92.

In this regard, the presence of a near-end talker speech signal such as double-talk may allow the filter factor of the Volterra filter, $\underline{\hat{H}}_k$, to diverge when updating the Volterra filter factor. Accordingly, the near-end talker speech signal generator 202 may generate a near-end talker speech signal through a double-talk detection algorithm in a frequency domain.

As an example, if the power spectrum of the nonlinear acoustic echo signal, $\hat{\lambda}_d(i,k)$, is calculated by the acoustic echo signal estimator 201, the near-end talker speech signal generator 202 may generate a near-end talker speech signal, in which a nonlinear acoustic echo signal is suppressed, by using the calculated the power spectrum $\hat{\lambda}_d(i,k)$ and a gain function based on a statistical model.

The near-end talker speech signal generator 202 may first calculate Near-end Speech Absence Probability (NSAP), which is based on complex Laplacian probability distribution, from the calculated the power spectrum $\hat{\lambda}_d(i,k)$.

For example, the near-end talker speech signal generator 202 may calculate a Probability Density Function (PDF) through Equation 9 and Equation 10 as follows, and then calculate NSAP from the calculated PDF and the Bayes's rule.

$$p_L(Y(i,k)\,|\,h_0)=\frac{1}{\lambda_d(i,k)}\exp\left\{-\frac{2(|Y_R(i,k)|+|Y_I(i,k)|)}{\sqrt{\lambda_d(i,k)}}\right\} \quad \text{[Equation 9]}$$

$$p_L(Y(i,k)\,|\,h_1)=\frac{1}{\lambda_s(i,k)+\lambda_d(i,k)}\exp\left\{-\frac{2(|Y_R(i,k)|+|Y_I(i,k)|)}{\sqrt{\lambda_s(i,k)+\lambda_d(i,k)}}\right\} \quad \text{[Equation 10]}$$

Equation 9 and Equation 10 are made by applying complex Laplacian probability distribution into Equation 1. $p_L(Y(i,k)|h_0$ may denote PDF of $h_0$ which indicates when there is no speech, and $p_L(Y(i,k)|h_1$ may denote PDF of $h_1$ which indicates when there is a speech.

In Equation 9 and Equation 10, $\lambda_g(i,k)$ may denote dispersion of a near-end talker speech signal, $Y_R(i,k)$ may denote a real number value of Y(i,k), and $Y_+(i,k)$ may denote an imaginary number value of Y(i,k). The Laplacian distribution may be more useful than the Gaussian distribution in modeling a speech signal, which contains noise, in a frequency domain.

Accordingly, the near-end talker speech signal generator 202 may calculate NSAP by using the Bayes's rule, PDF of $h_0$, and PDF of $h_1$, the PDFs being obtained respectively from Equation 9 and Equation 10. For example, as the near-end talker speech signal generator 202 applies the Bayes's rule to PDF with Equation 11 to Equation 13 which are given as follows, it may be accomplishable to calculate NSAP.

During this, the near-end talker speech signal generator 202 may estimate a prior near-end speech presence probability ratio Q to calculate NSAP. For example, the near-end talker speech signal generator 202 may use a data-driven algorithm to adaptively estimate the prior near-end speech presence probability ratio Q. The data-driven algorithm may be an algorithm which preliminarily determines the optimum value of Q according to ξ(i,k) and γ(i,k) by using massive data of an acoustic echo signal and a speech signal, stores the optimum value of Q in a form of a table, and then provide a variable Q according to ξ(i,k) which varies in the acoustic echo signal suppression system.

[Equation 11]

$$P_L(h_0 \mid Y(i,k)) = \frac{p_L(Y(i,k) \mid h_0)P(h_0)}{p_L(Y(i,k) \mid h_0)P(h_0) + p_L(Y(i,k) \mid h_1)P(h_1)} = \frac{1}{1 + Q \cdot \Lambda_L(Y(i,k))}$$

In Equation 11, $P_L(h_0|Y(i,k)$ may denote NSAP, and Q may denote the prior near-end speech presence probability ratio and may be given in $Q=P(h_1)/P(h_1)$. In this regard, Q may have a variable value according to $\xi(i,k)$ and $\gamma(i,k)$. $\Lambda_L(Y(i,k))$ May be given in Equation 12, and $\xi(i,k)$ and $\gamma(i,k)$ may be given in Equation 13, as follows.

[Equation 12]

$$\Lambda_L(Y(i,k)) = \frac{p_L(Y(i,k) \mid h_1)}{p_L(Y(i,k) \mid h_0)} = \frac{1}{1+\xi(i,k)}\exp\left\{2\left(\frac{|Y_R(i,k)| + }{|Y_I(i,k)|}\right) \cdot \left(\frac{|Y(i,k)| - \sqrt{\lambda_d(i,k)}}{|Y(i,k)|\sqrt{\lambda_d(i,k)}}\right)\right\}$$

[Equation 13]

$$\gamma(i,k) \equiv \frac{|Y(i,k)|^2}{\lambda_d(i,k)}, \xi(i,k) \equiv \frac{\lambda_s(i,k)}{\lambda_d(i,k)}$$

Additionally, the near-end talker speech signal generator 202 mat use a Decision Directed (DD) method and power of a nonlinear acoustic echo signal to calculate $\xi(i,k)$ and $\gamma(i,k)$. For example, the near-end talker speech signal generator 202 may calculate $\xi(i,k)$ from Equation 14 given as follows.

[Equation 14]

$$\hat{\xi}(i,k) = \alpha_{DD}\frac{|\hat{S}(i-1,k)|^2}{\lambda_d(i-1,k)} + (1-\alpha_{DD})U[\gamma(i,k)-1],$$
$$U[z] = z \text{ if } z \geq 0,$$
$$U[z] = 0 \text{ otherwise}$$

In Equation 14, the near-end talker speech signal generator 202 may calculate $\xi(i,k)$ by using the DD method where $\alpha_{DD}$ is 0.3. Then, the near-end talker speech signal generator 202 may obtain the prior near-end speech presence probability ratio Q, which corresponds to the calculated $\xi(i,k)$, from the table which is preliminarily stored through the data-driven method. Accordingly, the near-end talker speech signal generator 202 use the obtained prior near-end speech presence probability ratio Q to calculate NSAP. For example, $\xi(i,k)$ and $\gamma(i,k)$ may be divided with an interval of 20 dB and the optimum Q(i,k) may match every grid and be preliminarily stored in a table. The Q(i,k) in each grid may be a value which minimizes $J[E^2(i,k)]=[S(i,k)-\ddot{S}(i,k)]^2$.

The near-end talker speech signal generator 202 may generate a bear-end speech signal, in which a nonlinear acoustic echo signal is suppressed, from the NSAP and a gain function which is based on statistical model. For example, the near-end talker speech signal generator 202 may generate and output a near-end talker speech signal, in which a nonlinear acoustic echo signal is suppressed, based on Equation 15 given as follows.

$$\hat{S}(i,k)=(1-P_L(h_0|Y(i,k)))G_{MMSE}(\hat{\xi}(i,k),\hat{\gamma}(i,k))Y(i,k) \quad \text{[Equation 15]}$$

According to Equation 15, the near-end talker speech signal generator 202 may use a Minimum Mean Square Error (MMSE) to a gain function $G_{MMSE}$ which is based on a statistical model. Additionally, the near-end talker speech signal generator 202 may use NSAP to calculate near-end talker speech signal presence probability $1-P_L(h_0|Y(i,k))$. Additionally, the near-end talker speech signal generator 202 may multiply the near-end talker speech signal presence probability $1-P_L(h_0|Y(i,k))$ by the gain function $G_{MMSE}$, which is based on a statistical model, to generate a near-end talker speech signal $\hat{S}(i,k)$.

Figure 3:
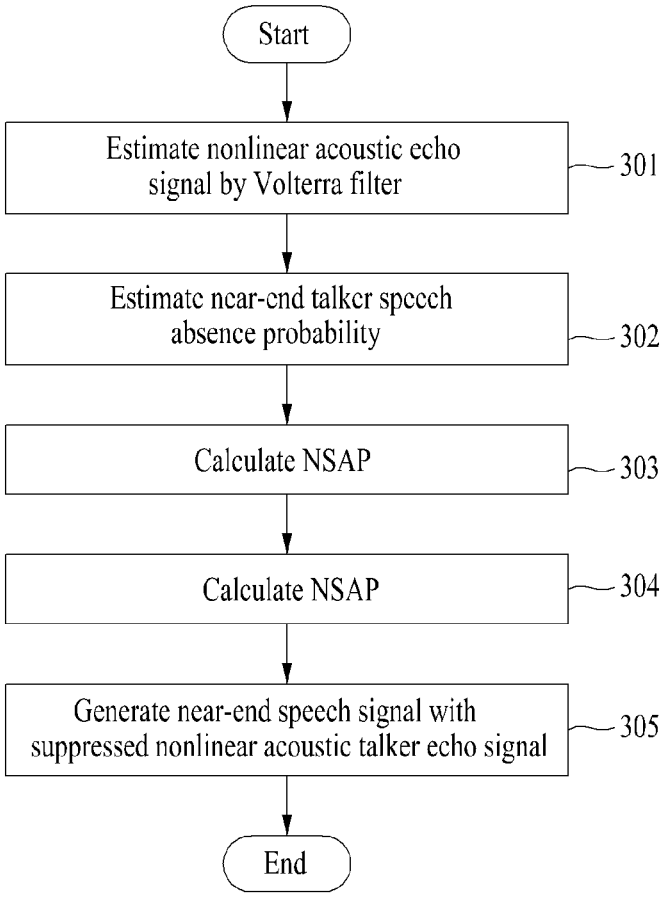
FIG. 3 is a flow chart showing a nonlinear acoustic echo signal suppression method according to an embodiment of the inventive concept.

FIG. 3 is a flow chart showing a nonlinear acoustic echo signal suppression method according to an embodiment of the inventive concept.

In FIG. 3, the nonlinear acoustic echo signal suppression method may be performed by the nonlinear acoustic echo signal suppression system of FIG. 2.

Referring to FIG. 3, at step 301, the acoustic echo signal estimator 201 may use a Volterra filter in a frequency domain to estimate a nonlinear acoustic echo signal.

During this, the acoustic echo signal estimator 201 may use MTLS to estimate a filter factor $\underline{\hat{H}}_k$ of the Volterra filter. Additionally, the acoustic echo signal estimator 201 may use the estimated Volterra filter factor $\underline{\hat{H}}_k$ and an input signal $\underline{X}_{i,k}$ to estimate a nonlinear acoustic echo signal $\hat{D}(i,k)$. For example, the acoustic echo signal estimator 201 may use a secondary Volterra filter, based on Equation 2 to Equation 7, to estimate a nonlinear acoustic echo signal.

Then, the acoustic echo signal estimator 201 may use an amplitude of the nonlinear acoustic echo signal, $|\hat{D}(i,k)|$, and a long-term smoothing method to calculate a power spectrum $\hat{\lambda}_d(i,k)$ of the nonlinear acoustic echo signal.

Subsequently, at step 302, the near-end talker speech signal generator 202 may use a data-driven algorithm to adaptively estimate the prior near-end speech presence probability ratio Q. In this regard, according to $\xi(i,k)$ and $\gamma(i,k)$, the optimum value of Q, which is variable, may be preliminarily stored in a table based on the data-driven algorithm.

Then, the near-end talker speech signal generator 202 may calculate $\xi(i,k)$ and $\gamma(i,k)$ based on power of the nonlinear acoustic echo signal and the DD method where $\alpha_{DD}$ is 0.3. For example, the near-end talker speech signal generator 202 may calculate $\xi(i,k)$ based on Equation 14 aforementioned. And, the near-end talker speech signal generator 202 may obtain Q, which corresponds to $\xi(i,k)$ and $\gamma(i,k)$, from the table.

Subsequently, at step 303, the near-end talker speech signal generator 202 may use the prior near-end speech presence probability ratio Q to calculate NSAP.

Next, at step 304, the near-end talker speech signal generator 202 may calculate NSPP from the NSAP.

For example, the near-end talker speech signal generator 202 may calculate NSPP by subtracting NSPP from 1.

Subsequently, at step 305, the near-end talker speech signal generator 202 may suppress a nonlinear acoustic echo signal based on NSPP and a gain function based on a statistical model. In other words, a nonlinear acoustic echo signal may be suppressed or removed to generate a near-end talker speech signal.

For example, the near-end talker speech signal generator 202 may use MMSE to calculate a gain function $G_{MMSE}$ which is based on a statistical model. Additionally, the near-end talker speech signal generator 202 may suppress or remove a nonlinear acoustic echo signal by multiplying the near-end talker speech signal presence probability by the gain function $G_{MMSE}$ which is based on a statistical model. Then, a near-end talker speech signal $\hat{S}(i,k)$ may be suppressed in nonlinear acoustic echo signal or generated without a nonlinear acoustic echo signal.

Hereinafter, FIGS. 4 to 6 will be now referred to describe experimental results showing the performance of a nonlinear acoustic echo signal suppression system and method in accordance with an embodiment of the inventive concept.

For this experiment, each microphone input signal may be generated in consideration of clipping, loudspeaker dynamics, and room impulse response. In this regard, the clipping may be generated using Equation 16 and Equation 19.

$$x_{hard}(n) = \begin{cases} -x_{max}, & x(n) < -x_{max} \\ x(n), & x(n) \le x_{max} \\ x_{max}, & x(n) > x_{max} \end{cases} \quad \text{[Equation 16]}$$

$$x_{soft}(n) = \frac{x_{max}x(n)}{\sqrt{|x_{max}| + x(n)}} \quad \text{[Equation 17]}$$

In Equation 16 and Equation 17, $x_{max}$ may denote the maximum volume of an input signal. During this, distortion of the loudspeaker may be generated based on Equation 18 given as follows.

$$x_{nl} = \gamma\left(\frac{1}{1 + \exp(-p \cdot q(n))} - \frac{1}{2}\right) \quad \text{[Equation 18]}$$

$$p = 4 \text{ if } q(n) > 0$$

$$p = 1/2 \text{ otherwise}$$

$$q(n) = \frac{3}{2}x(n) - \frac{3}{10}x^2(n)$$

In Equation 18, γ may be predetermined in 2.

This experiment was carried out to obtain a near-end speech presence probability under conditions of applying a room impulse response, which is generated from an image method algorithm, and assuming an office environment which is four-cornered in the capacity of 5×4×3 $m^3$. For simulation with the acoustic echo signal condition, a distance until an acoustic echo signal output from a speaker reached a microphone was considered to attenuate by 3.5 dB in synthesis. Echo Return Loss Enhancement (ERLE) and Speech Attenuation (SA) were used as objective evaluation indexes.

Additionally, for comparison with performance, an acoustic echo signal suppressor which is based on a traditional soft decision, a nonlinear acoustic echo signal remover using a raised-cosine function, and an acoustic echo signal remover updating a Volterra filter of frequency domain by NLMS were compared with a nonlinear acoustic echo signal suppression system and method. Especially, in a nonlinear acoustic echo signal suppression system and method, there was defined K=123, 128-tap, and the step-size of 0.3 for the raised-cosine algorithm. Additionally, there was defined 0.3 for an acoustic echo signal remover based on a Volterra filter in a frequency domain.

Figure 4:
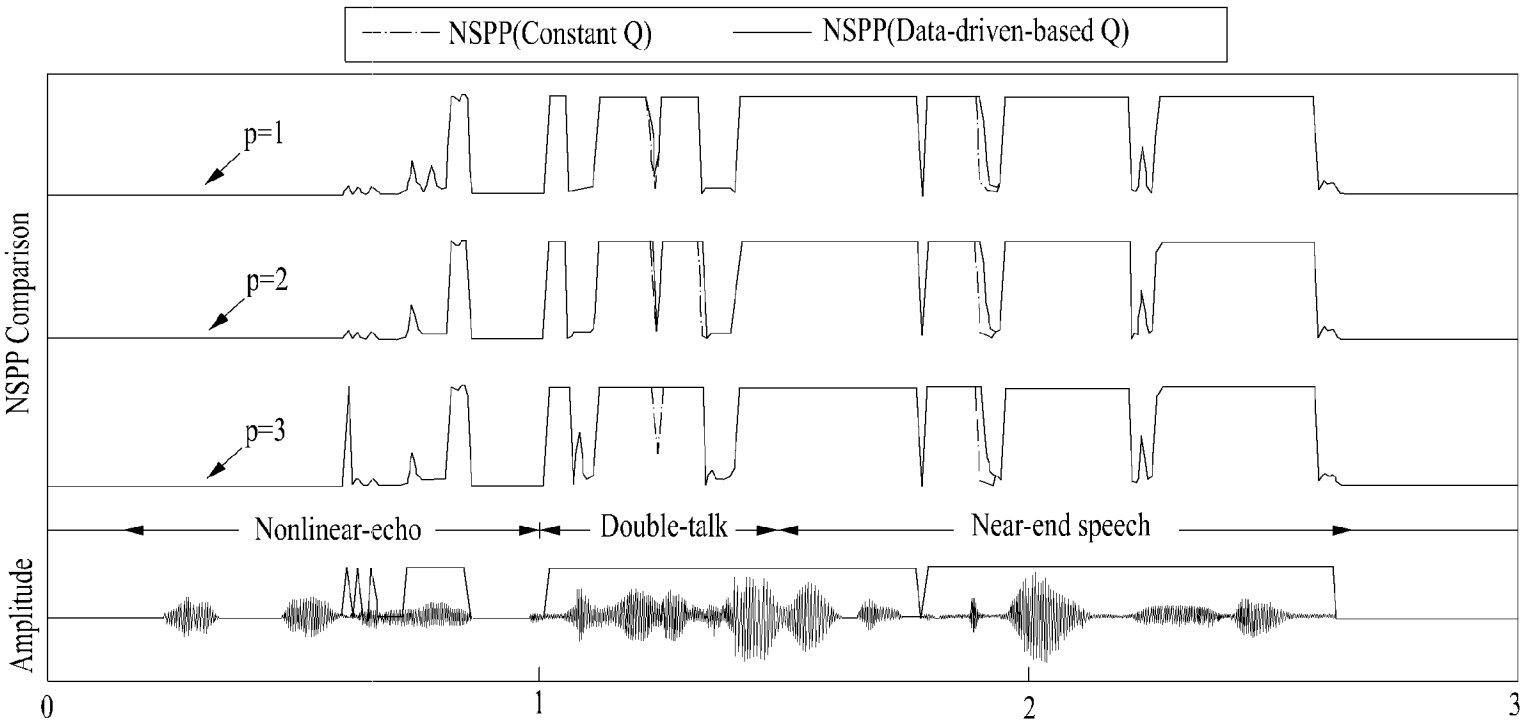
FIG. 4 is a graphic diagram showing near-end speech presence probability based on a data-driven method in an embodiment of the inventive concept.

FIG. 4 is a graphic diagram showing NSPP based on a data-driven method in an embodiment of the inventive concept.

In FIG. 4, 315 speech data were used for algorithm test and 105 speech files were used for training a data-driven table.

From FIG. 4, in regard to NSPP according to various degrees ρ, it can be seen that NSPP is outstanding when ρ is 2 than when ρ is 1 or 3.

Figure 5:
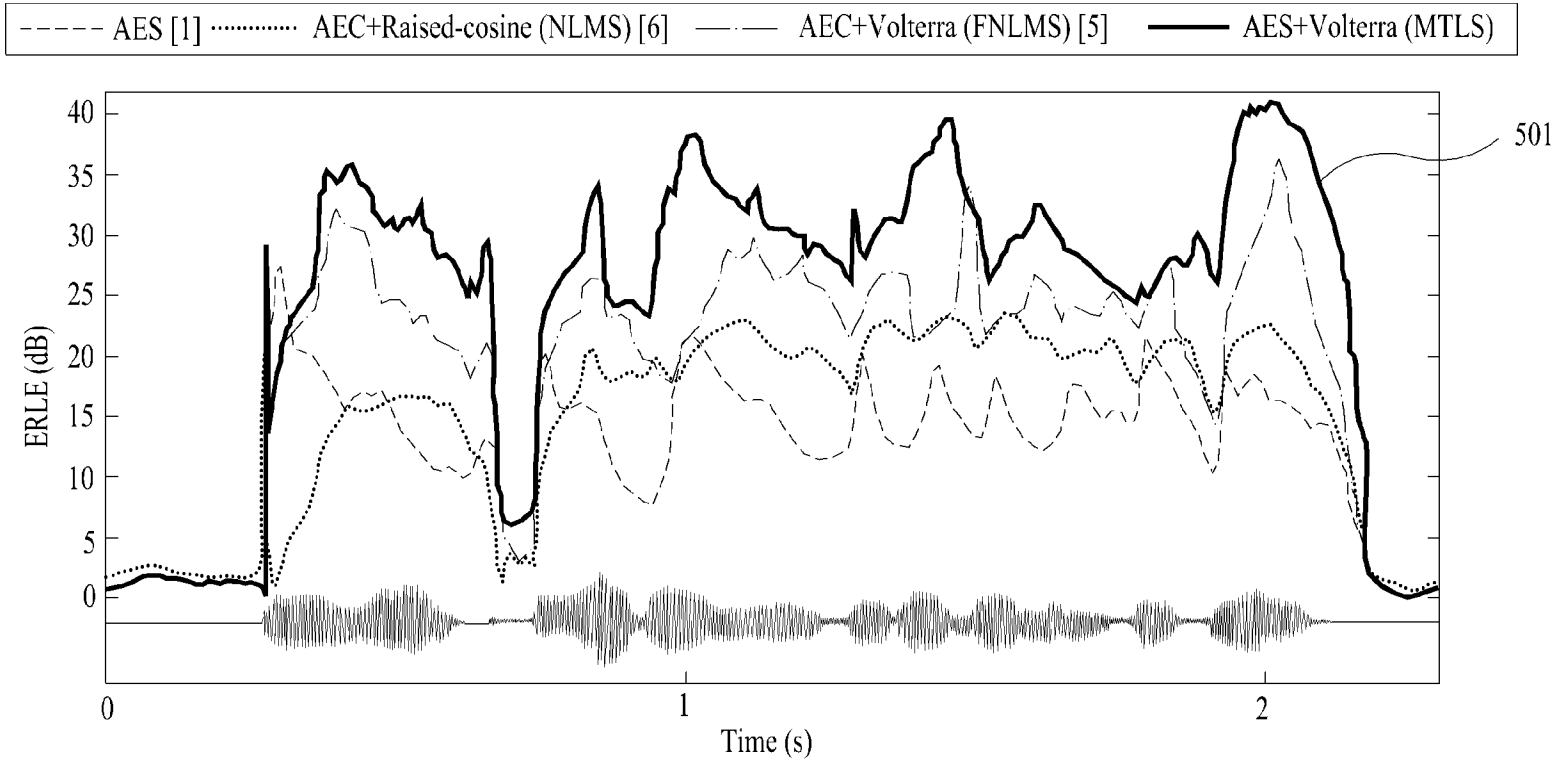
FIG. 5 is a graphic diagram showing variations of ERLE along time in an embodiment of the inventive concept.

FIG. 5 is a graphic diagram showing variations of ERLE along time in an embodiment of the inventive concept.

From FIG. 5, it can be seen that ERLE is most highly valued when MTLS is used to estimate a filter factor of a Volterra filter and a near-end talker speech signal is generated from the estimated Volterra filter factor and a gain function which is based on a statistical model. In other words, it can be seen that an ERLE value 501 of a nonlinear acoustic echo signal suppression system is most high. This may show that an acoustic echo signal is desirably suppressed in a period where there is no near-end talker speech signal.

Figure 6:
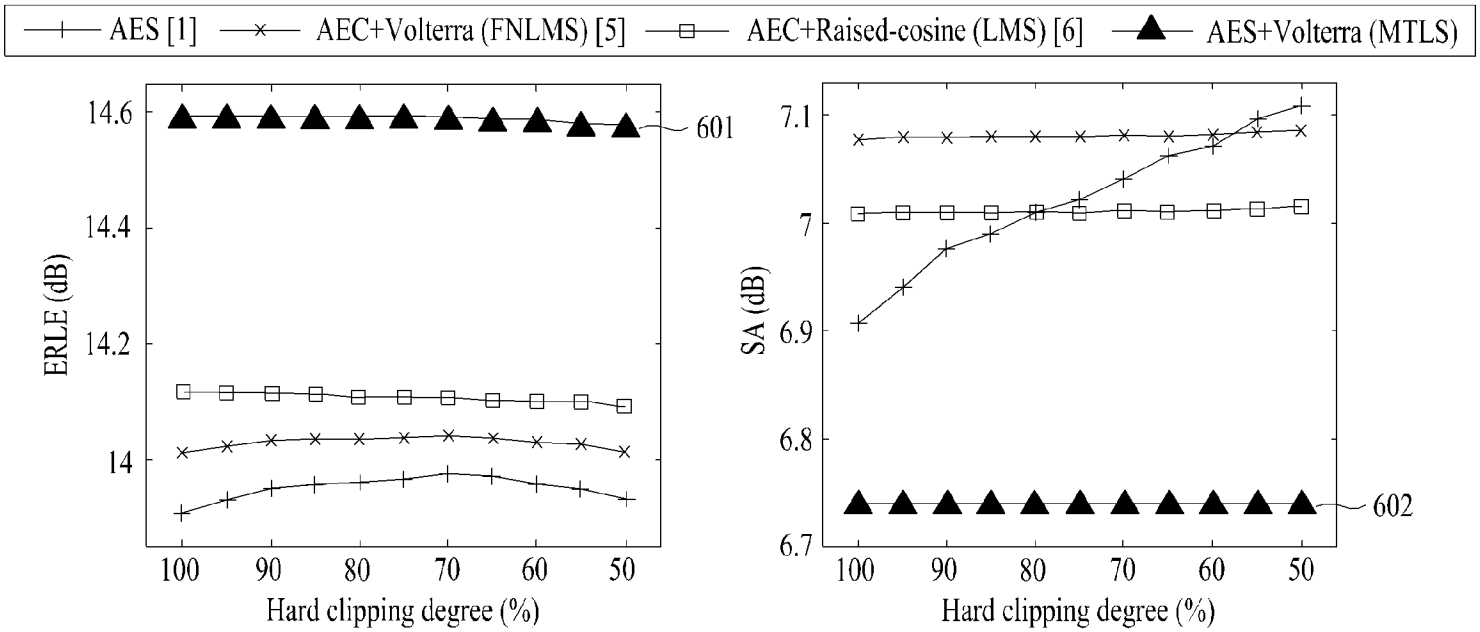
FIG. 6 is a graphic diagram showing performance of ERLE and SA under a hard clipping environment in an embodiment of the inventive concept.
Figure 7:
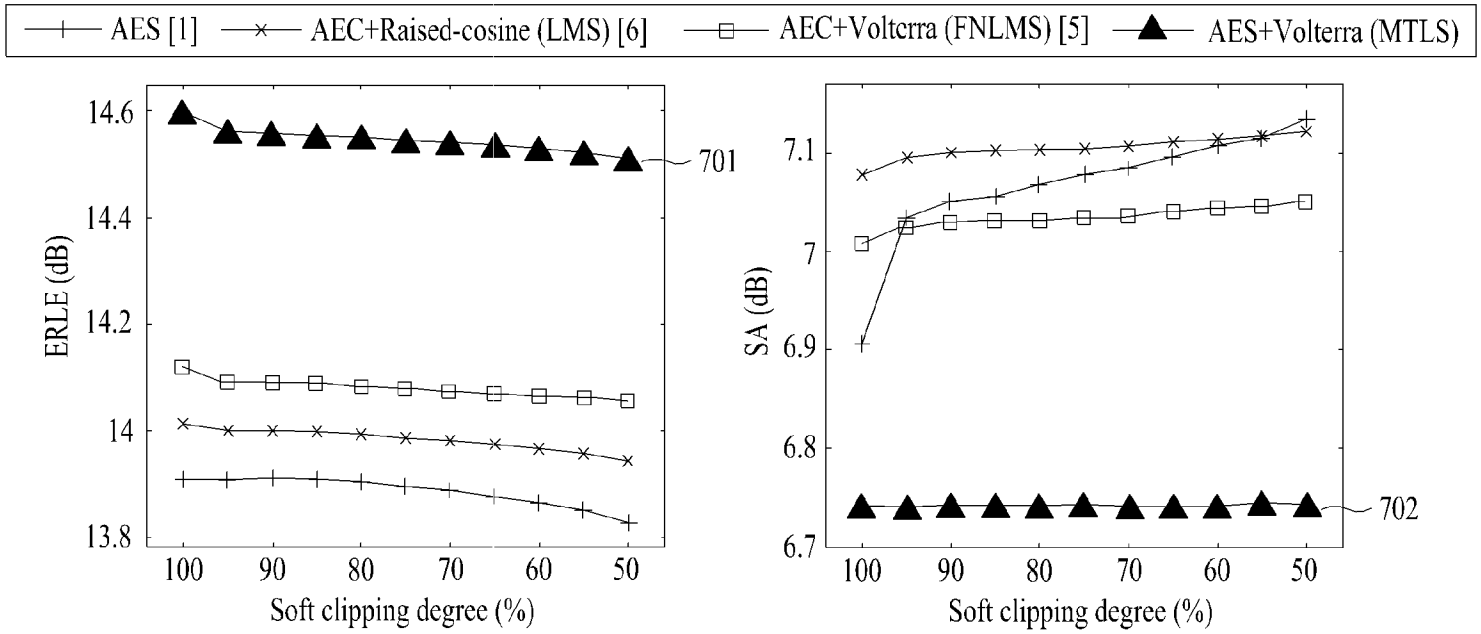
FIG. 7 is a graphic diagram showing performance of ERLE and SA under a soft clipping environment in an embodiment of the inventive concept.

FIG. 6 is a graphic diagram showing performance of ERLE and SA under a hard clipping environment in an embodiment of the inventive concept, and FIG. 7 is a graphic diagram showing performance of ERLE and SA under a soft clipping environment in an embodiment of the inventive concept.

From FIGS. 6 and 7, it can be seen that the ERLE using MTLS is scored higher than general algorithms while the SA is scored lower than such general algorithms.

A higher ERLE score may mean that an acoustic echo signal is desirably suppressed in a period where there is no near-end talker speech signal, and a lower SA score may mean that speech distortion is less generated in a period where there is a near-end talker speech signal. Accordingly, it can be seen that a nonlinear acoustic echo signal suppression system and method according to an embodiment of the inventive concept is useful in more desirably removing a nonlinear acoustic echo signal, as well as more desirably preserving speech quality, than general algorithms.

FIG. 8 is a diagram showing Mean Opinion Score (MOS) test results in an embodiment of the inventive concept.

As shown in FIG. 8, subjective evaluation for speech quality is carried out through a MOS test in a nonlinear acoustic echo signal suppression and method according to an embodiment of the inventive concept.

Referring to FIG. 8, it can be seen that, throughout both the hard clipping environment and the soft clipping environment, a nonlinear acoustic echo signal suppression system according to an embodiment of the inventive concept is superior to general algorithms in performance.

A nonlinear acoustic echo signal suppression method according to embodiments of the inventive concept may be implemented in the form of program instructions, which are executable through diverse computing tools, and recorded in a computer readable recording medium. Such a computer readable recording medium may include program instructions, data files, and data structures independently or combinably. The program instructions recorded in the medium may be specifically designed and configured for embodiments of the inventive concept, or commonly usable by those skilled in the computer software art. Computer readable recording media may include hardware devices, which are specifically configured to store and execute program instructions, for example, magnetic media, CD-ROM, optical media such as DVD, magneto-optical media such as floptical disks, Rom, RAM, flash memory, and so on. Program instructions may include, for example, high-class language codes which are executable through a computer by using an interpreter, as well as machine language codes which are like codes made by a compiler. Such hard devices may be formed to operate as one or more software modules for performing functions of embodiments of the inventive concept, and the reverse is the same.

While the inventive concept has been described with reference to exemplary embodiments, it will be apparent to those skilled in the art that various changes and modifications may be made without departing from the spirit and scope of the inventive concept set forth throughout the annexed claim matters. For example, although the aforementioned technical features are carried out in other sequences different from the manners described above, and/or the aforementioned elements, such as systems, structure, devices, and circuits, are combined or associated each other in other forms different from the described above, or replaced or substituted with other elements or equivalents, advantageous effects according to the inventive concept may be accomplished without further endeavors.

Therefore, it should be understood that the above embodiments are not limiting, but illustrative, hence all technical things within the annexed claims and the equivalents thereof may be construed as properly belonging to the territory of the inventive concept.

What is claimed is:

1. A nonlinear acoustic echo signal suppression system comprising:

an acoustic echo signal estimator configured to estimate a nonlinear acoustic echo signal by using a Volterra filter in a frequency domain; and a near-end talker speech signal generator configured to generate a near-end speech absence probability (NSAP) by applying Bayes's rule to a speech absence probability distribution function (PDF), a speech presence PDF, and a prior near-end speech presence probability ratio, and to generate a near-end talker speech signal by suppressing the nonlinear acoustic echo signal based on the NSAP and a gain function, wherein the acoustic echo signal estimator is configured to estimate a filter factor of the Volterra filter by using a multi-tap least square estimator, and estimate the nonlinear acoustic echo signal by using the filter factor of the Volterra filter.

2. The nonlinear acoustic echo signal suppression system according to claim 1, wherein the acoustic echo signal estimator uses multiple taps to estimate the filter factor.

3. The nonlinear acoustic echo signal suppression system according to claim 1, wherein the near-end talker speech signal generator is configured to estimate the prior near-end speech presence probability ratio, which is variable from a data-driven algorithm.

4. The nonlinear acoustic echo signal suppression system according to claim 3, wherein the prior near-end speech presence probability ratio is variable according to the near-end talker speech signal, and wherein the near-end talker speech signal generator is configured to generate the speech absence PDF and the speech presence PDF based on a complex Laplacian probability distribution.

5. The nonlinear acoustic echo signal suppression system according to claim 1, wherein the near-end talker speech signal generator is configured to calculate the NSAP based on a complex Laplacian model.

6. A nonlinear acoustic echo signal suppression method comprising:

estimating a nonlinear acoustic echo signal by using a Volterra filter in a frequency domain; generating a near-end speech absence probability (NSAP) by applying Bayes's rule to a speech absence probability distribution function (PDF), a speech presence PDF, and a prior near-end speech presence probability ratio; and generating a near-end talker speech signal by suppressing the nonlinear acoustic echo signal is suppressed based on the NSAP and a gain function, wherein estimating the nonlinear acoustic echo signal comprises: estimating a filter factor of the Volterra filter by using a multi-tap least square estimator; and estimating the nonlinear acoustic echo signal by using the filter factor of the Volterra filter.

7. The nonlinear acoustic echo signal suppression method according to claim 6, wherein the multi-tap least square estimator estimates the filter factor of the Volterra filter is estimated using multiple taps.

8. The nonlinear acoustic echo signal suppression method according to claim 6, wherein generating the near-end talker speech signal comprises: estimating the prior near-end speech presence probability ratio, which is variable, from a data-driven algorithm.

9. The nonlinear acoustic echo signal suppression method according to claim 8, further comprising: generating the speech absence PDF and the speech presence PDF based on a complex Laplacian probability distribution, wherein the prior near-end speech presence probability ratio is a variable according to a near-end talker speech signal.

10. The nonlinear acoustic echo signal suppression method according to claim 6, wherein generating the near-end talker speech signal comprises: calculating the NSAP based on a complex Laplacian model.

11. A method, comprising:

estimating a nonlinear acoustic echo signal by applying the Volterra filter to the converted input signal in in a frequency domain;

calculating a power spectrum of the nonlinear acoustic echo signal; calculating a speech absence probability distribution function (PDF) and a speech presence PDF using the power spectrum of the nonlinear acoustic echo signal; generating a near-end speech absence probability (NSAP) by applying Bayes's rule to the speech absence PDF, the speech presence PDF, and a prior near-end speech presence probability ratio; generating a near-end speech presence probability (NSPP) based on the NSAP; and generating a near-end talker speech signal by suppressing the nonlinear acoustic echo signal in the converted input signal, the near-end talker speech signal being generated by multiplying the NSPP, a gain function, and the converted input signal, wherein estimating the nonlinear acoustic echo signal comprises: estimating a filter factor of the Volterra filter by using a multi-tap least square estimator; and estimating the nonlinear acoustic echo signal by using the filter factor of the Volterra filter.

* * * * *